US006679857B1

(12) United States Patent
Bastia et al.

(10) Patent No.: US 6,679,857 B1
(45) Date of Patent: Jan. 20, 2004

(54) MASSAGERS HAVING GEL COVERINGS

(75) Inventors: Paul A. Bastia, Cranston, RI (US); Alan E. Strick, Harrisville, RI (US)

(73) Assignee: Conair Corporation, Stamford, CT (US)

( * ) Notice: Subject to any disclaimer, the term of this patent is extended or adjusted under 35 U.S.C. 154(b) by 183 days.

(21) Appl. No.: 09/800,154

(22) Filed: Mar. 6, 2001

(51) Int. Cl.[7] ..... A61H 1/00; A61H 23/02

(52) U.S. Cl. ..... 601/72; 601/80; D24/214; D24/215

(58) Field of Search ..... 601/46, 72, 73, 601/80, 3, 4, 2; D24/214, 215

(56) References Cited

U.S. PATENT DOCUMENTS

D100,481 S * 7/1936 Stranszky ..... D24/215
5,265,614 A * 11/1993 Hayakawa et al. ..... 600/459
5,471,988 A * 12/1995 Fujio et al. ..... 601/3
5,626,554 A * 5/1997 Ryaby et al. ..... 601/2
5,941,838 A * 8/1999 Eizenhofer ..... 601/2

* cited by examiner

*Primary Examiner*—Danton D. DeMille
(74) *Attorney, Agent, or Firm*—Ohlandt, Greeley, Ruggiero & Perle, LLP

(57) ABSTRACT

A massager with an improved interface preferably including a housing with a massage actuator positioned within the housing. The massage actuator is positioned in the housing so that the massaging head which is attached to the housing may receive the massaging impulses created by the massage actuator. The massaging head preferably has a portion of the head covered by a gel covering which is flexible to conform to the various contours of a user's body while at the same time effectively transmitting the massaging impulse to the users. The massaging head may have portions which are not covered by the gel bed to further increase the versatility of the massager so that should the user wish to focus the massaging impulse to a specific area it may be done at the users convenience. It is envisioned that the improved interface may be used on portable handheld massagers, foot massagers, and various computer and/or keyboard wrist rests and mouse pad rests.

6 Claims, 6 Drawing Sheets

MASSAGERS HAVING GEL COVERINGS

BACKGROUND OF THE INVENTION

1. Field of the Invention

The present invention relates generally to massaging units having soft pliable gel coverings to enhance the effectiveness thereof.

2. Description of the Prior Art

The present invention relates handheld and other types of massagers. Such massagers are often battery operated, but may also include adapters to be plugged into an AC outlet. Massagers may be used on a variety of areas on the body.

Handheld massagers are compact so that they may be held in the hand while being used on another part of the body. These massagers usually have a mechanism for creating vibratory motions in a head portion that is used to contact an area of the body. The massager works by transmitting vibrations from the head of the massager to the body to soothe the muscles underneath the skin and promote circulation. Typically the massager heads have hard surfaces made of a material such as rigid rubber or plastic for contacting the body. Since the head portion of the massager is typically made of a rigid material, it is not able to fully conform to the contours of the body part that it engages. This may reduce its effectiveness in transmitting the vibrations to the underlying muscle tissue. In addition, the vibrations that are transmitted to the body may be too focused on a particular area and not provide a significant amount of area to cover the body part that is intended to be massaged. Other types of massagers are also characterized by rigid surfaces for contacting the person. Some, however, have included gel packs. U.S. Pat. Nos. 5,593,212 and 5,902,256 disclose massagers including gel-filled portions.

There is a need for massagers having flexible heads that are able to conform to the shape of the body to better transmit the vibrations from the motor in the massager. In addition, there is a need for massagers that provide soothing and circulation enhancing vibrations to the body, while at the same time not creating a situation where the vibrations may be too focused or intense in one area so as to be ineffective in providing satisfactory relief.

SUMMARY OF THE INVENTION

It is an advantage of the present invention to provide a massager having a flexible contact surface which easily conforms to the shape of the users body.

It is another advantage of the present invention to provide a massager surface that is not only flexible but which also distributes and transmits the massaging impulses from the massager to a part of the body being contacted by the massager.

It is further an advantage of the present invention to provide a massager that may be used in the form of a portable handheld massager or a foot massager.

It is still another advantage of the present invention to provide a massager having a gel covering to conform to the user's body while at the same time transmitting the massaging impulses from the massage actuator.

It is further an advantage of the present invention to provide a gel pad massaging unit which may be used as a wrist rest for either a computer keyboard or typewriter or computer mouse.

In accordance with one form of the present invention the massager has an improved interface having a housing which has a massager head attached to a handle that houses a massage actuator. The massaging head is connected to the handle which receives the massaging impulses from the massage actuator. In one embodiment of the present invention, the massaging head may be mounted pivotally to the handle so that it may be moved in various directions to accommodate the user. The massaging head has a massaging surface which may be partially covered by a gel covering. In the preferred embodiment of the present invention the portion that is not covered by the gel covering may be made of a rigid rubber or plastic material so that the user may focus the massaging impulses from the massage actuator to a specific area of the body. In another embodiment of the present invention the gel cover may completely cover the massaging head so that the user may have a comfortable surface with which to use the massager.

The gel covering may be made of a soft fabric to encase the gel which is enclosed therein. The gel is preferably of a consistency that is soft and pliable yet allows the massaging impulses of the massage actuator to be evenly distributed about the massaging surface of the gel covering.

The present invention also envisions using the gel covering on a foot massager. The foot massager may include a housing which houses the massage actuator and the foot massager may have at least one gel pad on the upper surface for the user's feet to contact. The foot massager may have depressions in the upper surface to indicate where the user may place his/her feet and the gel pads may be positioned within these depressions so that the massaging impulse from the massage actuator may be evenly distributed on the user's feet. In one embodiment of the present invention, the foot massager may have portions in the depressions where there are percussion nodes which create a tapping sensation on the bottoms or sides of the users feet. These percussion nodes may be made of a rigid rubber or plastic material and are preferably not covered by the gel pad.

The present invention may also be used in such items as a computer keyboard wrist rest and a mouse pad rest. The wrist rests may include a gel padding on the top of a wrist rest that is to be placed adjacent to the computer keyboard. A massage actuator may be housed within the wrist rest under a top gel covering to provide a soothing massaging impulse to the user. It is also envisioned that a mouse pad may be integrated with a wrist rest so that a user may comfortably use the wrist rests with a mouse pad.

A preferred form of each of the massagers having gel coverings as well as other embodiments, objects, features and advantages of the present invention will be apparent from the following detailed description of illustrative embodiments thereof which is to be read in conjunction with the accompanying drawings.

DETAILED DESCRIPTION OF THE PREFERRED EMBODIMENT

Figure 1:
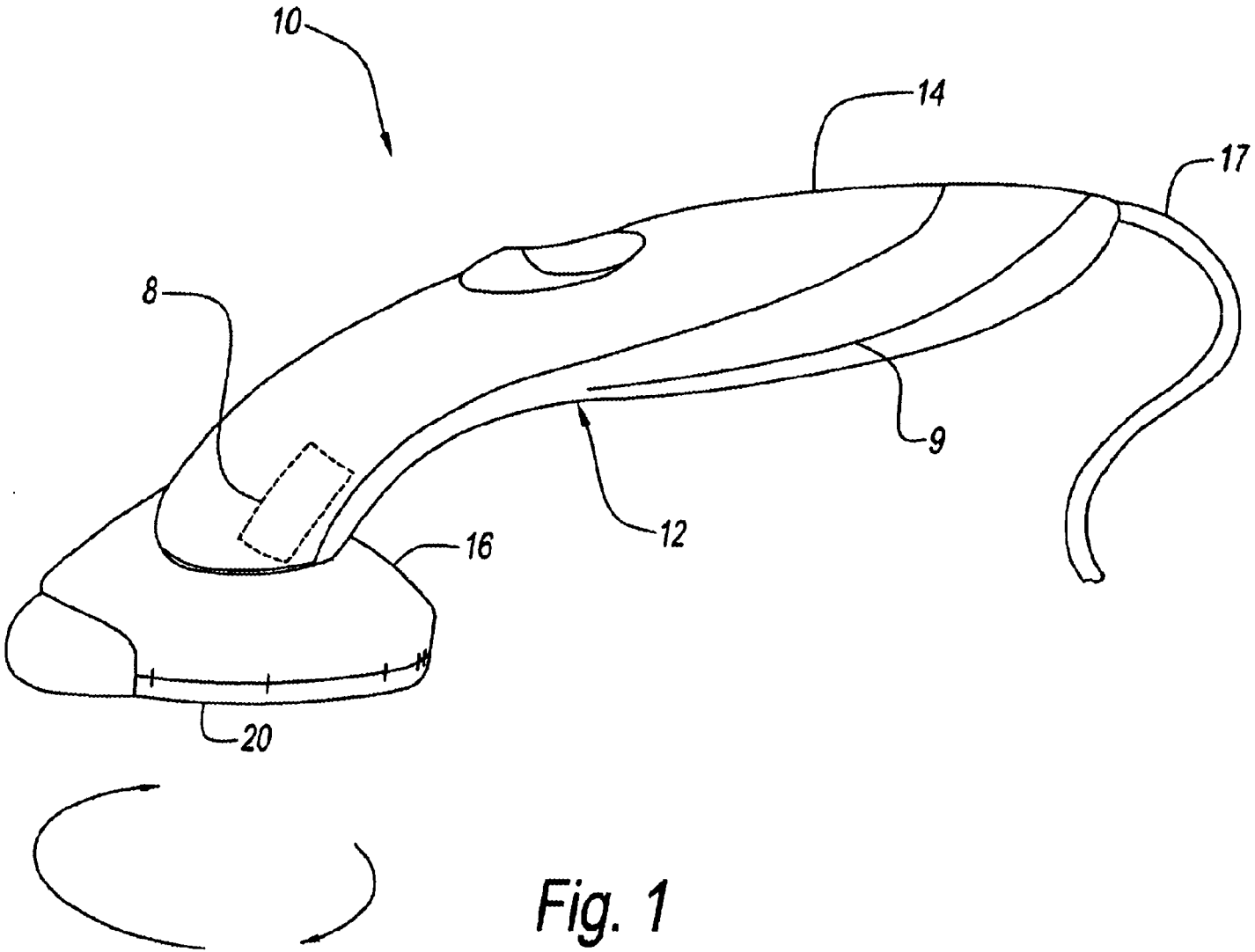
FIG. 1 is a top perspective view of a handheld massager of the present invention.

Referring to FIG. 1, one preferred embodiment of the present invention may be in the form of a handheld massager 10. The massager 10 has a housing 12 having a handle 14, so that the user may hold the massager 10 in one hand while using it and a head 16 that is mounted to one end of the handle 14. One or more massage actuator 8 is provided for transmitting massaging impulses to the head 16. The massage actuator 8 may include mechanical or electromechanical devices adapted to provide one or more various types of massaging impulses. To achieve such impulses, massage actuator 8 may include eccentric motors, solenoid driven actuators, rotating rollers or other mechanisms as is known in the art. In the preferred embodiment, the massage actuator 8 creates a massaging impulse that is described as a vibration action for exemplary purposes. The massage actuator 8 is shown schematically positioned in the handle 14 and may be positioned in or near the head 16. The handle 14 may include a battery compartment 9 for use when the massager 10 is not plugged into an AC outlet. A power cord 17 is connected to the handle for connecting the massager 10 to a wall outlet. The massage actuator 8 is powered by either batteries or the cord 17.

The head 16 may be pivotally mounted to the handle 14. Preferably the head 16 is mounted so that it may rotate with respect to the handle 14 as shown by the arrows in FIG. 1. The head 16 by being movable in relation to the handle 14 allows the user to more conveniently position the massager 10 where needed. In the preferred embodiment the head 16 has a triangular configuration. One advantage of having the triangular shape is that the user may use the corners of the head 16 to more specifically focus the vibration when needed. Any appropriate shape for the head may be used depending on the user's needs or aesthetic tastes.

In the preferred form of the present embodiment a gel pad 20 is attached to the head 16 of the massaging unit 12. The gel pad 20 may be attached integrally to the head 16 by permanently attaching it with an adhesive. In the alternative, the gel pad 20 may be attached by a temporary adhesive or the use of a hook and loop closure, so that the gel pad 20 may be replaced at the user's convenience. The means of attachment is not deemed critical. The gel pad 20 is preferably shaped so that when in use, the user may press the gel pad 20 against the specific part of the body needed and not contact any other parts of the massager head 16 if so desired.

Figure 2:
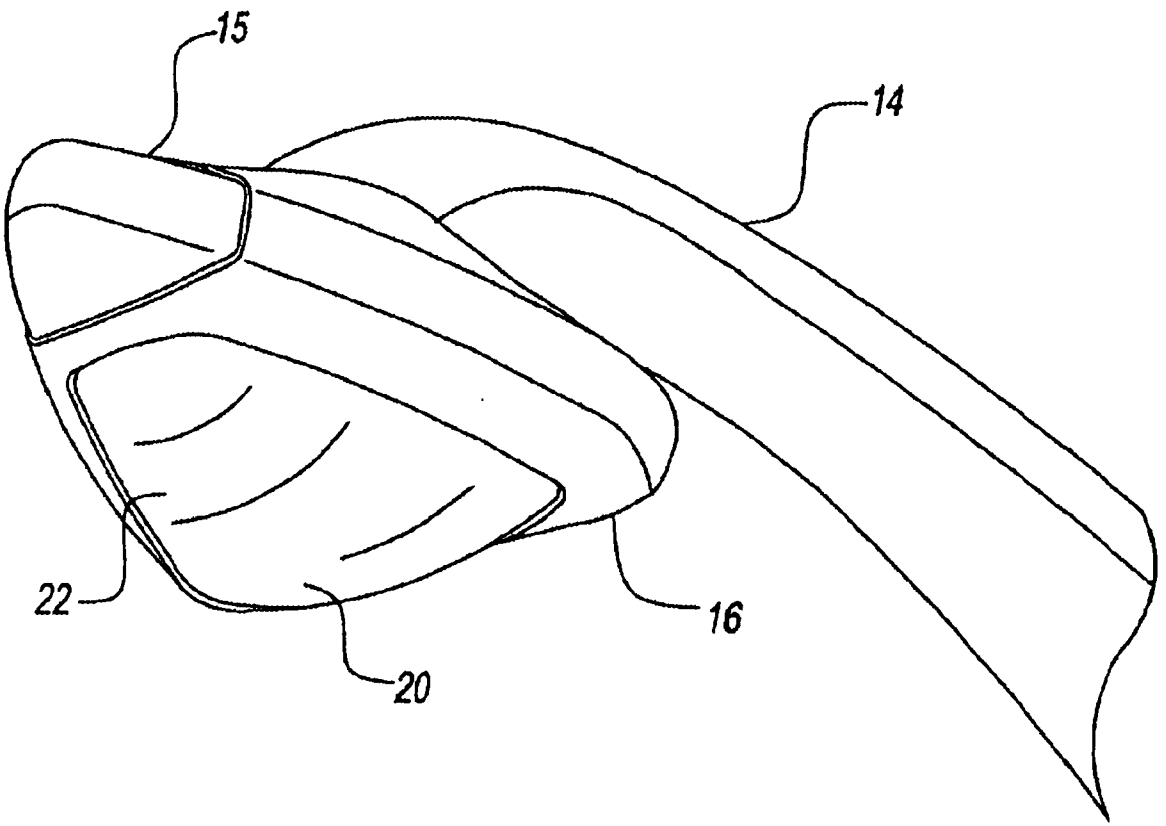
FIG. 2 is a bottom perspective view of the handheld massager as shown in FIG. 1.

Referring to FIG. 2, the gel pad 20 may be filled with a silicon-based gel so that it is easily moldable and readily conforms to the contours of the body. Gel pad 20 is preferably encased by a resilient outer surface 22. The head 16 may include a node 15 made of hard rubber this is not covered by the gel pad 20. The advantage to having this configuration is that the user may more accurately focus the massaging impulses to a specific part of the body when needed. The node is preferably located where shown to allow the user to easily employ it for relieving tension "knots".

One advantage of using the gel pad is that the vibrations from the head 16 are easily transferred through the gel since it is made of an incompressible material, thus the vibrations pass through the gel pad 20. However, the gel pad 20 also has the further advantage of conforming to the user's body, so that the vibrations are dispersed over a wider area, namely, the entire gel surface 22, which conforms to the user's body. Therefore, the vibrations from the massager 12 are more evenly disbursed along the gel surface 22. On the other hand, the massager 10 is versatile in that it also provides a rigid surface should the user wish to "focus" the vibrations over a particular point on the body.

Figure 2A:
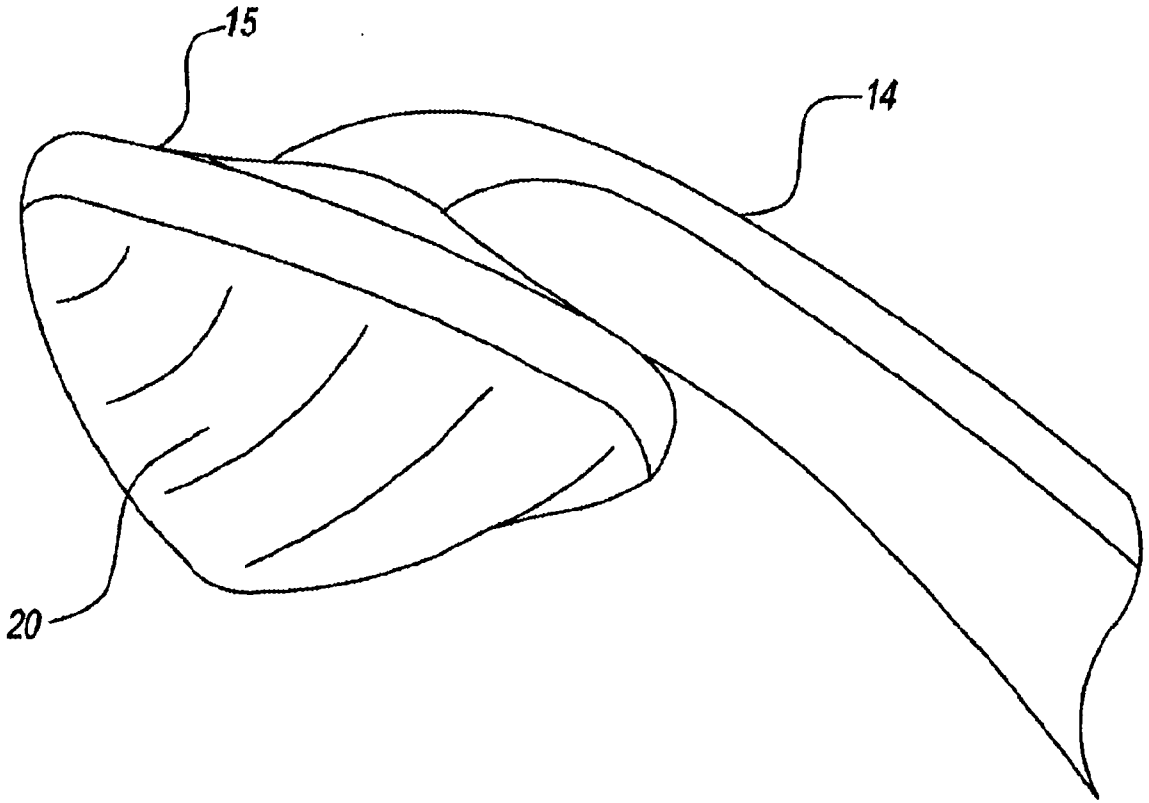
FIG. 2A is a bottom perspective view of an alternative embodiment of the handheld massager.

An alternative embodiment of the massager head 16 is shown in FIG. 2A. The head 16 may have the gel pad 20 completely covering the head 16. Since the head 16 will be completely covered by the gel pad 20, the node 15 is eliminated in the alternative embodiment.

Figure 3:
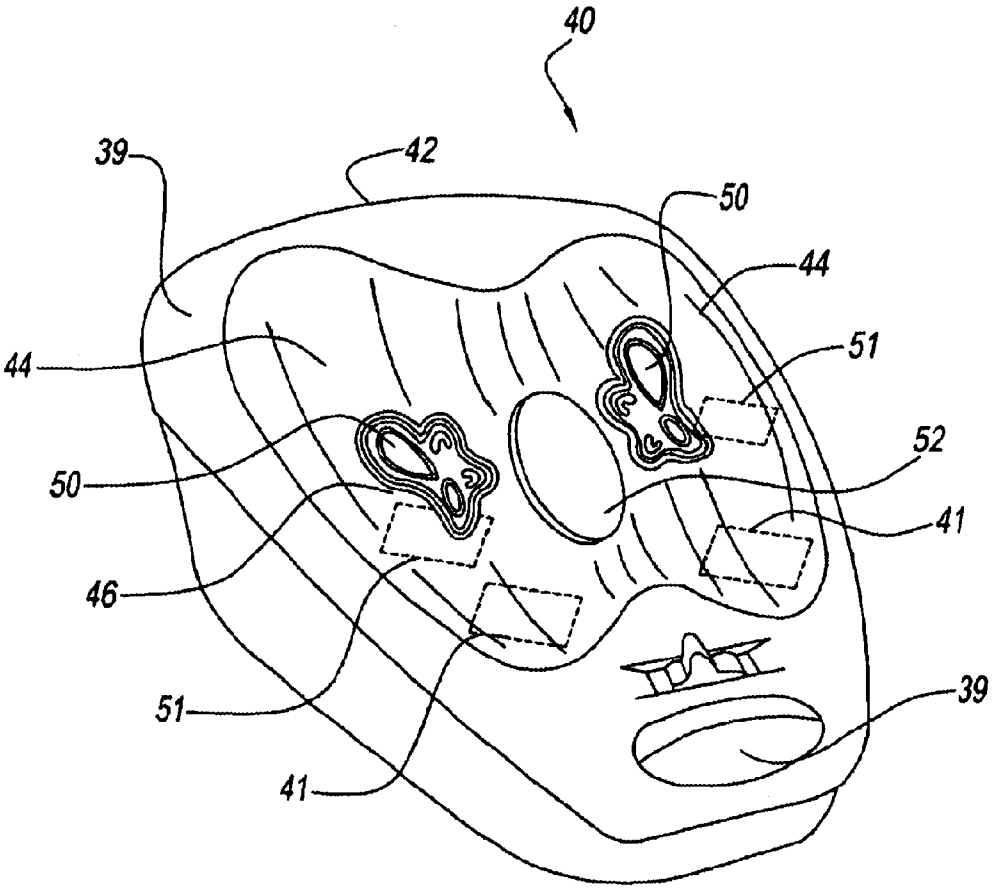
FIG. 3 is a top perspective view of a foot massager of the present invention.

FIG. 3 shows a foot massager 40 of the present invention. In the preferred embodiment, the foot massager 40 has a housing 42 which contains one or more massage actuators 41. The housing 42 may have a molded handle 39 so that the massager may easily be moved. The massage actuators 41 are well known in the art and are not described in detail. In the preferred embodiment, the massage actuators 41 create a massaging impulse which is described as a vibration action for exemplary purposes. On the housing 42 of the foot massager 40, there are two depressions 44 where the user places his/her feet. One or more gel pads 46 are positioned over massage actuators 41, and are sufficiently resilient to conform to the bottom and sides of the feet. The massage actuators 41 are positioned so that vibrations can be felt on the bottoms and sides of the feet.

In the preferred embodiment, the depressions 44 are positioned on the inclined top surface 39 of the housing 42. The depressions 44 may be used as a visual indicator to the user for the correct placement of their feet on the massager 40. Preferably, the depressions 44 will be shaped in the general outline of an average person's feet positioned in a side by side relationship. The depressions 44 are preferably shaped to follow the bottom contours of the user's feet to further increase comfort for the user.

The gel pads 46 are of the same general nature and construction as the gel pad used in the massager shown in FIG. 1, but are adapted to conform to the feet. The gel pad 46 is preferably about the same size as the depressions 44 and follow the contours of the depressions 44 to create a comfortable surface and aesthetically pleasing appearance. Preferably, in the center of each depression 44, there is a cutout in the gel pad 46 so that percussion nodes 50 may be employed. Preferably the percussion nodes 50 are made so that they provide a stimulating repetitive type of tapping motion on the area of the foot touching the nodes 50. The percussion nodes 50 may be of varying shapes and designs to both stimulate the user's feet and to provide an aesthetically pleasing appearance. A heat panel 52 is provided in the preferred embodiment, and is positioned between the depressions 44. The heat panel 52 preferably has a smooth texture and is sufficiently warm to create a soothing heat. The user may use the heat panel 52 by placing a foot in close proximity or in direct contact thereon to increase comfort.

The massage actuators 41 may create vibration impulses that are transmitted through the gel pad(s) and/or the nodes. Tapping motors 51 may be provided for use with the percussion nodes 50 and are shown schematically in the drawings. Tapping motors 51 are well known in the art and are not described in detail. The user's feet would be placed on the gel pad surface 48, so that vibrations from the massage actuator 41 would be felt along substantially the entire portions of the feet in contact with the gel pad. The gel pad 46 would conform to the individual shape of the person's foot to provide a deep and more soothing massage. The present invention envisions using percussion nodes 50 in only specific areas of the depressions 44 so that a more focused and/or different type of stimulation can be transmitted to the appropriate areas of the feet. The advantage of using a flexible gel pad 46 which disperses and transmits the vibrations from the massage actuator 41 and conforms to the individual user's feet is still retained in the foot massager 40 embodiment of the present invention.

Figure 4:
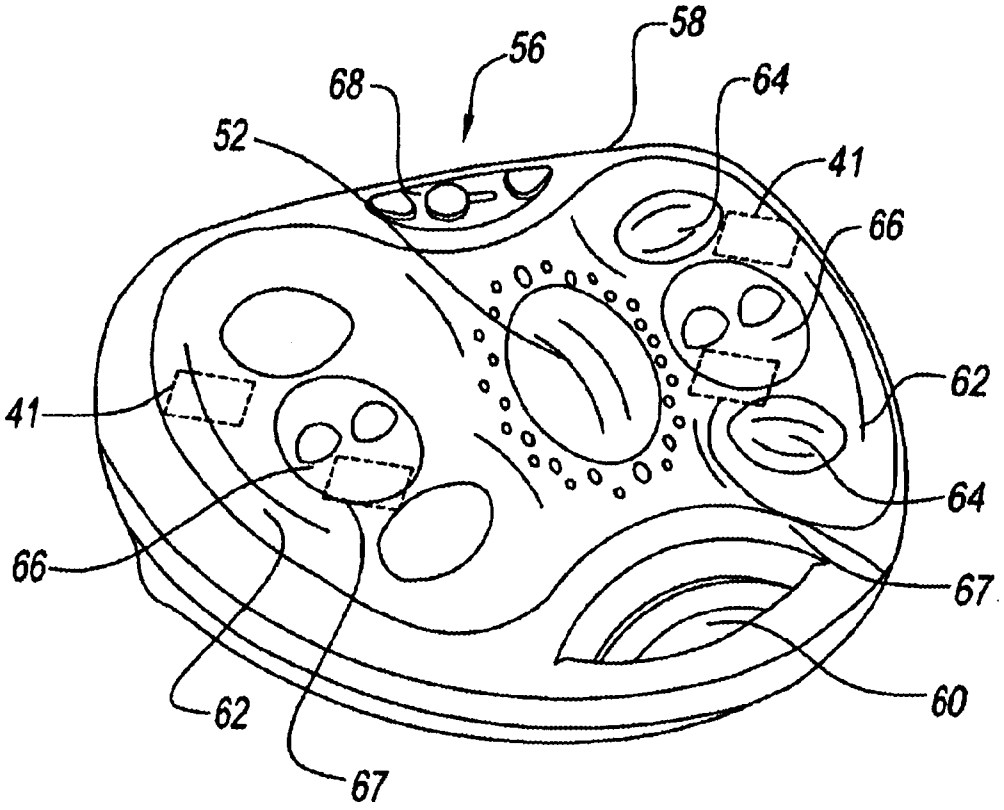
FIG. 4 is a top perspective view of an alternative embodiment of a foot massager of the present invention.

An alternative embodiment of the foot massager 56 is shown in FIG. 4. The foot massager 56 having a housing 58 with an integrally molded handle 60 so that the user may easily move the massager 56 when needed. The housing 58 may contain similar massage actuators 41 as described in the embodiment shown in FIG. 3. The housing 58 of the foot massager 56 may have two depressions 62 where the user places his/her feet. One or more gel pads 64 are positioned in depressions 62 preferably over the massage actuators 41 or in close relation thereto. The gel pads 64 are sufficiently resilient to conform to the bottom and sides of the feet. The gel pads 64 are of the same general nature and construction as the gel pad used in the massager shown in FIG. 3.

The depressions 62 may be of the same general construction as the depressions 44 as shown in FIG. 3. The depressions 62 in the embodiment shown in the alternative embodiment are preferably only partially covered by the gel pads 64. The gel pads 64 may be positioned so that they only touch the heel and ball/toes. An advantage to the design is that the gel pads 64 evenly distribute the massaging impulses to the areas of the user's feet where the most pressure is applied by the user, thereby increasing the comfort experienced.

The alternative foot massager 56 may have percussion nodes 66 positioned in the center of the depressions 62. The percussion nodes 66 preferably have a half sphere shape and move in an up and down motion to provide a repetitive type of tapping motion. Any shape for the nodes may be used depending on the user's needs or aesthetic tastes. The percussion nodes 66 positioned in each depression 62 may alternatively move in relation to each other to further increase the user's comfort. A tapping motor 67 may be positioned under the percussion nodes 66 in each depression 62 to move the percussion nodes. A heat panel 52 is provided and positioned between the depressions. There may be a control panel 68 with controls to separately operate each of the devices to tailor the massager for the user's needs.

Figure 6:
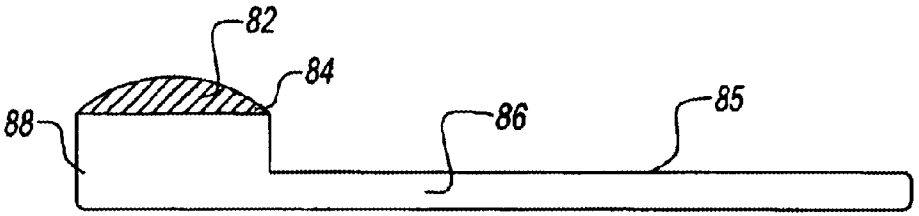
FIG. 6 is a side view of the mouse pad/wrist rest shown in FIG. 4.
Figure 5:
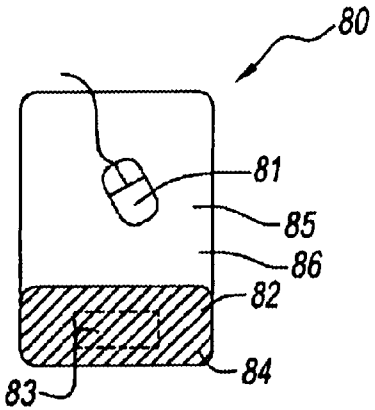
FIG. 5 is a top plan view of a mouse pad/wrist rest of the present invention.

FIGS. 5 and 6 show a mouse pad/wrist rest assembly 80 according to the present invention. The assembly 80 has a housing 88 with a resilient pad 85. Preferably the resilient pad 85 is a mouse pad that is well known in the art having a mouse pad surface 86 so that a computer mouse 81 may be used thereon. In the preferred embodiment the housing 88 has a gel pad 82 positioned on its top surface. A massage actuator 83, is shown schematically, for transmitting massaging impulses through the gel pad 82 is provided in a compartment beneath the gel pad 82, thus allowing the user to place his/her wrist on the top surface 84 of the gel pad 82. In the preferred embodiment, the massage actuator 83 creates a massaging impulse which is described as a vibration action for exemplary purposes.

One advantage to the wrist rest assembly 80 is that the user has a convenient and comfortable place to use the computer mouse 81. Preferably the housing 88 and resilient pad 85 are integrally manufactured thereby reducing the number of pieces in its construction.

Figure 8:
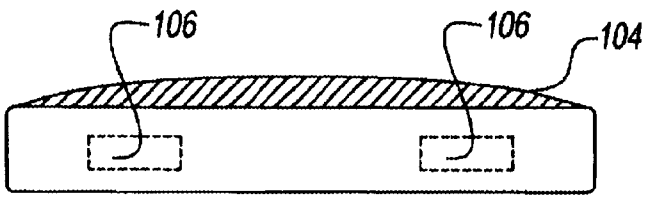
FIG. 8 is a side view of the keyboard pad as shown in FIG. 6.
Figure 7:
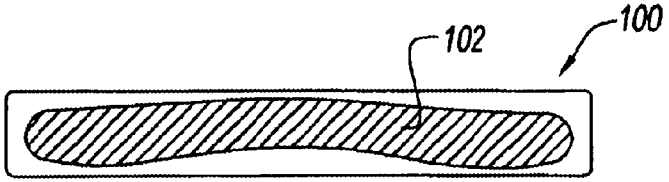
FIG. 7 is a top plan view of a keyboard pad of the present invention.

A computer keyboard pad 100 is shown in FIGS. 7 and 8. The construction of the keyboard pad 100 is similar to the wrist pad assembly 80 with housing 101 and a gel pad 102 positioned over at least one massage actuator 106, which is shown schematically. The length of the gel pad 102 is preferably about the same length as the keyboard that is to be used. The keyboard pad 100 is positioned so that the user's wrist may rest on the gel pad 102, no matter where the person's hands are on the keyboard. The user may turn on the massage actuator 106 to receive the massager impulse from the massage actuator(s) 106 through the gel pad 102, which allows a soothing massaging motion to be experienced by the user, since the top surface 104 of the gel pad 102 conforms to the shape of the user's wrist.

Although the illustrative embodiments of the present invention have been described herein with reference to the accompanying drawings, it is to be understood that the invention is not limited to those precise embodiments and that various other changes and modifications may be effected therein by one skilled in the are without departing from the scope or spirit of the invention, and that it is intended to claim all such changes and modifications as fall within the scope of the invention.

What is claimed is:

1. A massager with an improved interface comprising:

a housing having a handle and a massaging head;

a massage actuator in said housing for transmitting a massaging action to said massaging head; and a gel on a portion of said massaging head, said gel being sufficiently flexible to conform to various contours of a person's body and being sufficiently flexible for effectively transmitting said massaging action to a user from said massaging head over an area of said user's body covered by said gel, wherein said massaging head further comprises a node for transmitting said massaging action mounted to said massaging head, wherein said node is a hard rubber.

2. The massager of claim 1, wherein said gel substantially surrounds at least a portion of said massaging head.

3. The massager of claim 1, wherein said massaging head is substantially triangular.

4. The massager of claim 1, wherein said massaging head is pivotally mounted to said handle.

5. The massager of claim 1, wherein said gel is a silicon based gel.

6. A massager with an improved interface comprising:

a housing having a handle and a massaging head;

a massage actuator in said housing for transmitting a massaging action to said massaging head; and a gel on a portion of said massaging head, said gel being sufficiently flexible to conform to various contours of a person's body and being sufficiently flexible for effectively transmitting said massaging action to a user from said massaging head over an area of said user's body covered by said gel, wherein said massaging head further comprises a node for transmitting said massaging action mounted to said massaging head, and wherein said node is a hard rubber that does not cover said gel.

* * * * *